United States Patent [19]

Suzuki et al.

[11] Patent Number: 4,973,538

[45] Date of Patent: Nov. 27, 1990

[54] FUNCTIONALLY SEPRATED TYPE TONER FOR FIXING WITH HEATED ROLLS

[75] Inventors: Chiaki Suzuki; Masayoshi Shinoki; Koichi Kumashiro; Sueko Sakai; Emi Takahashi, all of Kanagawa, Japan

[73] Assignee: Fuji Xerox Co., Ltd., Tokyo, Japan

[21] Appl. No.: 308,223

[22] Filed: Feb. 9, 1989

[30] Foreign Application Priority Data

Feb. 10, 1988 [JP] Japan ..... 63-27424

[51] Int. Cl.[5] ..... G03G 9/087; G03G 9/09

[52] U.S. Cl. ..... 430/106; 430/109; 430/111

[58] Field of Search ..... 430/106, 109, 111, 904

[56] References Cited

U.S. PATENT DOCUMENTS 4,499,168 2/1985 Mitsuhashi ..... 430/99

FOREIGN PATENT DOCUMENTS 60-7434 1/1985 Japan ..... 430/109

63-214760 9/1988 Japan ..... 430/109

2078385 1/1982 United Kingdom ..... 430/109

*Primary Examiner*—Roland E. Martin

*Attorney, Agent, or Firm*—Finnegan, Henderson, Farabow, Garrett, and Dunner

[57] ABSTRACT

A toner for development of a latent electrostatic image containing a colorant and a binder resin formed of a mixture of a low-molecular weight component and a high-molecular weight component. Both the low-molecular weight component and high-molecular weight component are made from a styrene-acrylic copolymer where the weight ratio (A) of styrene to acrylic monomer in the low-molecular weight polymer component and an the weight ratio (B) of styrene to acrylic monomer in the high-molecular weight polymer component satisfies the relationship $A/B \leqq 1.3$. The mixing ratio of the low-molecular weight and high-molecular weight components is within the range of from 80:20 to 40:60. The weight-average molecular weight (Mw) and the number-average molecular weight (Mn) of the low-molecular weight polymer component satisfies the relationship $Mw/Mn \leqq 3.0$.

10 Claims, No Drawings

FUNCTIONALLY SEPRATED TYPE TONER FOR FIXING WITH HEATED ROLLS

FIELD OF THE INVENTION

The present invention relates to a toner for use in the development of a latent electrostatic image in electrophotography or electrostatic recording. More particularly, the present invention relates to a novel functionally separated type that is adapted for fixing with heated roller.

BACKGROUND OF THE INVENTION

In electrophotography, a latent electrostatic image is formed by various methods on a photoreceptor made of selenium or some other photoconductive material. The latent image is then rendered visible with toner particles deposited by a suitable development method such as magnetic brush development, and the toner image is transferred onto a receiving element such as paper or sheet and permanently fixed by suitable means such as heat, solvent, or pressure.

Toner image is most commonly fixed by thermal fusing, which is roughly divided into noncontact fusing and contact fusing. Since contact fusing with heated rollers achieves a higher thermal efficiency and enables high-speed fixing, it is used extensively in modern commercial copiers, printers, etc.

However, the method of fixing with heated rollers has several disadvantages. A particularly notable defect is that it consumes a considerable amount of energy or electric power, as compared to fixing by pressure rollers. Needless to say, fixing with heated rollers provides much stronger adhesion between the fixed image and paper or other receiving elements than fixing by pressure rollers, and offers the additional advantage that it prevents deformation or wrinkling of the paper that would otherwise occur upon application of pressure. Therefore, many researchers have conducted studies to find a way to reduce power consumption, or the minimum temperature necessary to fix toner image, when fixing with heated rollers.

One of the most effective approaches for attaining this objective is to reduce the glass transition temperature of the binder resin in a toner by several tens of degrees Celsius lower than the value used customarily. However, many of the toners designed in this way have a fatal defect in that they are prone to caking or agglomeration during storage within a copying machine.

A method was proposed wherein this problem would solved by depositing very fine particles of colloidal silica, alumina, titania, etc. on the surfaces of toner particles so that the latter will have improved anti-blocking and flow properties. This approach was seemingly effective because it achieved some improvement in anti-blocking and flow properties without substantially increasing the minimum temperature necessary to fix toner image. In fact, however, the fine particles mentioned above were found to be readily separable from toner surfaces even when heating or some other treatment was applied to have these particles fused to the latter. The detached particles caused adverse effects on photoreceptors, especially those which were coated with organic polymers, etc. on the surface. In other words, the fine particles separating from toner surfaces would be fixed semi-permanently to the photoreceptor's surface as a result of cyclic operation, causing various image defects. Therefore, depositing fine particles on toner surfaces is not a perfect solution to the problem of caking or agglomeration of toner particles.

Using a styrene acrylic copolymer binder of two-peak distribution which is composed of a low-molecular weight and a high-molecular weight component each having the same monomer ratio has been proposed in U.S. Pat. No. 4,499,168. Because of high miscibility between a high-molecular weight and a low-molecular weight component, however, it is difficult to control anti-offsetting and fixing characteristics independently by this method. If the proportion of the high-molecular weight component is increased, the fixing characteristics are modified for the worse. If the proportion of the low-molecular weight component is increased, the anti-offset characteristics will deteriorate. As a further problem, the fixed image of a toner that employs this styrene acrylic copolymer binder has a tendency to foul polyvinyl chloride (PVC) sheets used as copy files since the styrene-acrylic copolymer has high solubility in a plasticizer in the PVC sheet.

To solve this problem various methods have been adopted and one of them is to use a polyester binder. Polyesters have low solubility in the plasticizer in a PVC sheet and will not cause extensive fouling of the latter. On the other hand, polyesters have a tendency to become negatively charged by triboelectrification, and to produce a toner that is to be positively charged, they must be subjected to one or more treatments that would lead to a substantial increase in toner cost, such as modification, the increased addition of charge control agent, etc.

SUMMARY OF THE INVENTION

Therefore, the principal object of the present invention is to provide a toner that can be fixed with smaller power consumption, namely at a lower temperature, and which has good anti-offsetting properties.

Another object of the present invention is to provide a toner that can be manufactured efficiently at low cost.

Still another object of the present invention is to provide a toner that will not readily foul polyvinyl chloride sheets.

The present inventors conducted various studies to solve the aforementioned problems of prior art toners intended to be fixed thermally. As a result, they found that by using two styrene acrylic copolymers of different molecular weights as components of a binder resin with the ratio of monomers in each copolymer, the mixing ratio of the two copolymers and the molecular weight of the low-molecular weight polymer component being controlled to satisfy specified conditions, a toner for development of latent electrostatic images could be obtained that solved all of the aforementioned problems of the prior art. The present invention has been accomplished on the basis of this finding.

That is, the present invention relates basically to a toner for development of latent electrostatic images that comprises a colorant dispersed in a binder resin formed of a mixture of a low-molecular weight polymer component and a high-molecular weight polymer component. Each of the low-molecular weight and high-molecular weight components is made of a styrene-acrylic copolymer; the weight ratio (A) of styrene to acrylic monomer in the low-molecular weight polymer component and the weight ratio (B) of styrene to acrylic monomer in the high-molecular weight polymer component satisfies the relationship $A/B > 1.3$; the mixing weight ratio of the low molecular weight and high-molecular weight components is within the range of from 80:20 to 40:60; and the weight-average molecular weight (Mw) and the number-average molecular weight (Mn) of the low-molecular weight polymer component satisfies the relationship $Mw/Mn \leqq 3.0$.

In a preferred embodiment of the present invention, the glass transition temperature (TgL) of the low-molecular weight polymer component of the binder resin and the glass transition temperature (TgH) of the high-molecular weight polymer component satisfies the relationship $|TgL-TgH| \leqq 10°$ C.

DETAILED DESCRIPTION OF THE INVENTION

The mixing weight ratio of the low-molecular weight and high-molecular weight components is preferably from 75:25 to 55:45.

In the present invention, the weight ratio (A) of styrene to acrylic monomer in the low-molecular weight polymer component of a binder resin is varied from the weight ratio (B) of styrene to acrylic monomer in the high-molecular weight polymer component in such a way that A/B is greater than 1.3. At the same time, the ratio of the weight-average molecular weights (Mw) to number-average molecular weight (Mn) of the low-molecular weight polymer component is adjusted to be no higher than 3.0, preferably no higher than 2.5. By satisfying these two requirements, the miscibility between the low-molecular weight and high-molecular weight polymer components can be significantly lowered to provide a structure that is microscopically separated in phase.

This is effective in solving one of the major problems of the prior art and enables anti-offsetting properties and low-temperature fixability to be controlled independently of each other. In other words, low-temperature fixability is controlled by the low-molecular weight polymer component whereas anti-offsetting properties are controlled by the high-molecular weight polymer component. As a further advantage, the tendency to form a microscopically phase-separated structure helps produce a fixed image having a surface layer that is rich in the high-molecular weight polymer component. Thus, the surface layer is rich with the acrylic monomer of the high molecular weight polymer component, by virtue of the ratio A/B. Because of this richness in the acrylic component, the miscibility with the plasticizer in a PVC sheet is sufficiently reduced to solve the problem of fouling of that sheet.

The reduced miscibility between the low-molecular weight and high-molecular weight polymer components offers the added advantage of greatly improving the efficiency of toner production because the low-molecular weight polymer component is friable and can be readily ground into particles. If the glass transition temperature TgL of the low-molecular weight polymer component and the glass transition temperature TgH of the high-molecular weight polymer component are adjusted to satisfy the condition $|TgL-TgH| \leqq 10°$ C., toner blocking and flowability, which have been excessive in the prior art on account of the low Tg of the low-molecular weight component, can be effectively controlled to realize a functionally separated toner in which anti-blocking property, fixability, resistance to fouling of PVC sheets and production rate can be controlled independently of one another.

Particularly preferred conditions to be satisfied by the binder resin for use in the present invention are as follows:

| | |
|---|---|
| High-molecular weight polymer component | TgH = 40–80° C. |
| Low-molecular weight polymer component | TgL = 40–80° C. |
| Molecular weights of high-molecular weight polymer component | $Mn = 1 \times 10^5 - 5 \times 10^5$<br>$Mw = 1 \times 10^5 - 1 \times 10^6$ |
| Molecular weights of low-molecular weight polymer component | $Mn = 2 \times 10^3 - 1 \times 10^4$<br>$Mw = 2 \times 10^3 - 3 \times 10^4$ |

Glass transition temperatures were measured by differential scanning colorimetry (DSC) with a thermal analyzer Model DT-30 of Shimadzu Corp. Molecular weight measurements consisted of constructing calibration curves using 2 units of HLC-802A (Toyo Soda) column GMH6 and 10 standard polystyrenes, dissolving a specific binder sample in tetrahydrofuran (THF), and measuring its molecular weight on HLC-802A.

The molecular weight of a toner might experience a slight shift from that of a binder resin (before kneading) for some reason such as the cutting of molecules by the action of a kneader or the effect of incorporated additives. Even in this case, the molecular weights of the low-molecular weight polymer component of the binder in the toner desirably satisfy the following conditions: Mn: $2\times10^3-1\times10^4$; Mw: $2\times10^3-3\times10^4$; and $Mw/Mn \leqq 3.0$. If molecules of the high-molecular weight polymer component are out and its molecular weight makes a shift to the lower range, there often occurs a spread in the range of Mw/Mn of the low-molecular weight component. In order to ensure the intended separation of functions, the value of Mw/Mn of the low-molecular weight polymer component, namely, the ratio of its weight-average molecular weight to number-average molecular weight, must be adjusted to be no more than 3.0, preferably no more than 2.5.

Illustrative styrene monomers that may be employed in the styrene-acrylic copolymer of the present invention include styrene and substituted styrenes such as α-methylstyrene. The styrene-acrylic copolymers for both the low-molecular weight and high-molecular weight components preferably contain the styrene monomer(s) in an amount of 50 mol% or more, and the total content of the styrene monomer(s) in the mixture of the low-molecular weight and high-molecular weight components is preferably from 60 to 98 mol%.

Acrylic monomers that are preferably used as comonomers may be exemplified by esters of α-methylene aliphatic monocarboxylic acids such as methyl acrylate, ethyl acrylate, butyl acrylate, dodecyl acrylate, octyl acrylate, phenyl acrylate, ethyl methacrylate, butyl methacrylate, dodecyl methacrylate and methyl methacrylate.

Typical examples of colorant that can be incorporated in toner include carbon black, nigrosine dyes, aniline blue, calcoil blue, chrome yellow, ultramarine blue, Du Pont oil red, quinoline yellow, methylene blue chloride, phthalocyanine blue, malachite green oxalate, lamp black, and rose bengale. The colorant is generally incorporated in an amount of from 2 to 15% by weight and preferably from 4 to 10 by weight.

The binder resin and colorant that can be used in the present invention are by no means limited to the examples listed above.

If necessary, a charge control agent, a release agent or a magnetic material may be incorporated in the toner of the present invention.

The toner of the present invention may be either a magnetic toner having a magnetic material confined therein or an encapsulated toner. The average size of toner particles is generally adjusted to no greater than about 30 μm, preferably between 3 and 20 μm.

When the toner of the present invention is to be used as a two-component developing agent, any known carriers may be employed, such as an iron powder, a resin-coated carrier, and a carrier having a magnetic powder dispersed in a resin.

Various other additives may also be added to the developing agent, as required, to the toner of the present invention. Examples of such additives include a charge control agent, a cleaning aid, a flow accelerator, etc.

Illustrative examples of carrier particles that can be selected for mixing with the toner of the present invention include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating of vinyl polymers, or vinyl homopolymers, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, polytetrafluoroethylene, fluorine-containing polyacrylates, and polymethacrylates; copolymers of vinyl chloride; and trichlorofluoroethylene; and other known coatings. There can also be selected as carriers components comprised of a core with a double polymer coating thereover.

Carriers comprising a binder resin and a magnetic powder dispersed therein can also be used. Representative examples of the binder resin include homopolymers and copolymers of styrenes such as styrene, chlorostyrene, and vinylstyrene; monoolefins such as ethylene, propylene, butylene, and isobutylene; vinyl esters such as vinyl acetate, vinyl propionate, and vinyl benzoate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Typical binder resins that are useful starting materials in the process according to the present invention include polystyrene, a styrene-acrylic acid alkyl ester copolymer, a styrenemethacrylic acid alkyl ester copolymer, a styreneacrylonitrile copolymer, a styrene-butadiene copolymer, a styrene-maleic anhydride copolymer, and polyolefins such as polyethylene and polypropylene. In addition, polyesters, polyurethanes, epoxy resins, polyamides, modified resins, paraffins and waxes can be used.

As the magnetic powder which is the other component of the carrier, any conventionally used fine ferromagnetic particles can be used. Representative examples include triiron tetraoxide, Y-diiron trioxide, ferrites, chromium oxide, and metal powders.

The magnetic particle content in the carrier is usually from about 30 to 95 wt % and preferably from about 45 to 90 wt %.

In addition to the binder resin and fine magnetic particles, a charge controlling agent, a dispersion increasing agent, a strength-reinforcing agent, and a coupling agent can be incorporated in the carrier mixture, so long as no substantial amount of solvent is present. The term "solvent" used herein means a compound capable of dissolving the binder resin used in the carrier.

Also, while the diameter of the carrier particles can vary, generally they are of a diameter of from about 30 to about 1,000 μm, preferably 30 to 100 μm, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner of the present invention is intended to be used for developing a latent electrostatic image that is formed on a photoreceptor or an electrostatic recording element as follows: in the former case, a latent electrostatic image is formed electrophotographically on a photoreceptor made of an inorganic photoconductive materials such as selenium, zinc oxide, cadmium sulfide or amorphous silicon; and in the latter case, a latent electrostatic image is formed with stylus electrodes or by some other means on an electrostatic recording element having a dielectric such as polyethylene terephthalate. In either case, the latent electrostatic image is developed by a suitable method such as magnetic brush development, cascade development or touchdown development, so that the particles of the toner of the present invention are deposited on the latent image to form a toner image. This toner image is transferred to a receiving sheet such as paper and fixed to produce a permanent copy. The residual toner on the surface of the photoreceptor or any other surface is wiped off with various cleaning devices such as a blade, brush, web, or rollers.

The following examples are given for the purpose of further illustrating the present invention but are in no way to be taken as limiting. In the examples, all "parts" are on a weight basis.

EXAMPLE 1

| | |
|---|---|
| Low-molecular weight polymer component | 60 parts |
| (styrene-butyl methacrylate copolymer) | |
| (90/10) A = 9.0 | |
| Mw = $7.0 \times 10^3$ Mn = $4.0 \times 10^3$ | |
| Mw/Mn = 1.75 | |
| TgL = 59.3° C. | |
| High-molecular weight polymer component | 40 parts |
| (styrene-butyl methacrylate copolymer) | |
| (60/40) B = 1.5 | |
| Mw = $7.0 \times 10^5$ Mn = $2.2 \times 10^5$ | |
| TgH = 65.8° C. | |

These two components were mixed to form a resin mixture (A/B=6.0; |TgL−TgH|=6.5° C.

| | |
|---|---|
| Resin mixture | 100 parts |
| Carbon black (R-330 of Cabot Corporation) | 10 parts |
| Low-molecular weight polypropylene (Viscol 660P of Sanyo Chemical Industries, Ltd.) | 5 parts |
| Bontron P-51 (product of Orient Chemical Industry Co., Ltd.) | 1 part |

The above-listed components were melt-kneaded with a Banbury mixer, cooled, comminuted with a jet mill and classified with a classifier to obtain a toner having an average particle size of 11 μm. A carrier having an average particle size of 25 μm was produced by melt-kneading a styrene-butyl acrylate copolymer and a magnetic powder, comminuting the blend and classifying the fine particles.

Ninety parts of the carrier was mixed with 10 parts of the toner to prepare a developer composition.

EXAMPLE 2

| | |
|---|---|
| Low-molecular weight polymer component | 70 parts |
| (styrene-butyl acrylate copolymer) | |
| (90/10) A = 9.0 | |
| Mw = $7.6 \times 10^3$ Mn = $4.5 \times 10^3$ | |
| Mw/Mn = 1.69 | |
| TgL = 56.5° C. | |
| High-molecular weight polymer component | 30 parts |
| (styrene-butyl acrylate copolymer) | |
| (75/25) B = 3.0 | |
| Mw = $7.3 \times 10^5$ Mn = $3.8 \times 10^5$ | |
| TgH = 60.7° C. | |

These two components were mixed to form a resin mixture (A/B=3.0; |TgL−TgH|=4.2° C.

| | |
|---|---|
| Resin mixture | 100 parts |
| Carbon black (R-330 of Cabot Corporation) | 10 parts |
| Low-molecular weight polypropylene (Viscol 660P of Sanyo Chemical Industries, Ltd.) | 5 parts |
| Bontron P-51 (product of Orient Chemical Industry Co., Ltd.) | 1 part |

The above-listed components were treated as in Example 1 to prepare a developer composition.

EXAMPLE 3

| | |
|---|---|
| Low-molecular weight polymer component | 60 parts |
| (styrene-butyl acrylate copolymer) | |
| (85/15) A = 5.7 | |

-continued

| | |
|---|---|
| Mw = $6.2 \times 10^3$ Mn = $3.8 \times 10^3$ | |
| Mw/Mn = 1.63 | |
| TgL = 54.5° C. | |
| High-molecular weight polymer component | 40 parts |
| (styrene-methyl acrylate copolymer) | |
| (80/20) B = 4.0 | |
| Mw = $3.6 \times 10^5$ Mn = $2.1 \times 10^5$ | |
| TgH = 63.2° C. | |

These two components were mixed to form a resin mixture (A/B=1.4; |TgL−TgH|=8.7° C.

| | |
|---|---|
| Resin mixture | 100 parts |
| Carbon black (R-330 of Cabot Corporation) | 10 parts |
| Low-molecular weight polypropylene (Viscol 660P of Sanyo Chemical Industries, Ltd.) | 5 parts |
| Bontron P-51 (product of Orient Chemical Industry Co., Ltd.) | 1 part |

The above-listed components were treated as in Example 1 to prepare a developer composition.

COMPARATIVE EXAMPLE 1

| | |
|---|---|
| Low-molecular weight polymer component | 60 parts |
| (styrene-butyl methacrylate copolymer) | |
| (70/30) A = 2.3 | |
| Mw = $9.8 \times 10^3$ Mn = $2.9 \times 10^3$ | |
| Mw/Mn = 3.38 | |
| TgL = 41.2° C. | |
| High-molecular weight polymer component | 40 parts |
| (styrene-butyl methacrylate copolymer) | |
| (70/30) B = 2.3 | |
| Mw = $7.2 \times 10^5$ Mn = $3.4 \times 10^5$ | |
| TgH = 73.5° C. | |

These two components were mixed to form a resin mixture (A/B=1.0; |TgL−TgH|=32.3° C.

| | |
|---|---|
| Resin mixture | 100 parts |
| Carbon black (R-330 of Cabot Corporation) | 10 parts |
| Low-molecular weight polypropylene (Viscol 660P of Sanyo Chemical Industries, Ltd.) | 5 parts |
| Bontron P-51 (product of Orient Chemical Industry Co., Ltd.) | 1 part |

The above-listed components were treated as in Example 1 to prepare a developer composition.

COMPARATIVE EXAMPLE 2

| | |
|---|---|
| Low-molecular weight polymer component | 70 parts |
| (styrene-butyl acrylate copolymer) | |
| (90/10) A = 9.0 | |
| Mw = $11.3 \times 10^3$ Mn = $3.2 \times 10^3$ | |
| Mw/Mn = 3.53 | |
| TgL = 52.5° C. | |
| High-molecular weight polymer component | 30 parts |
| (styrene-butyl acrylate copolymer) | |
| (75/25) B = 3.0 | |
| Mw = $7.3 \times 10^5$ Mn = $3.8 \times 10^5$ | |
| TgH = 60.7° C. | |

These two components were mixed to form a resin mixture (A/B=3.0; |TgL−TgH|=8.2° C.

| | |
|---|---|
| Resin mixture | 100 parts |
| Carbon black (R-330 of Cabot Corporation) | 10 parts |
| Low-molecular weight polypropylene (Viscol 660P of Sanyo Chemical Industries, Ltd.) | 5 parts |
| Bontron P-51 (product of Orient Chemical Industry Co., Ltd.) | 1 part |

The above-listed components were treated as in Example 1 to prepare a developer composition.

COMPARATIVE EXAMPLE 3

| | |
|---|---|
| Low-molecular weight polymer component | 60 parts |
| (styrene-butyl methacrylate copolymer) (85/15) A = 5.7 | |
| Mw = $12.5 \times 10^3$ Mn = $3.0 \times 10^3$ | |
| Mw/Mn = 4.17 | |
| TgL = 44.0° C. | |
| High-molecular weight polymer component | 40 parts |
| (styrene-butyl methacrylate copolymer) (82/18) B = 4.6 | |
| Mw = $8.2 \times 10^5$ Mn = $4.2 \times 10^5$ | |
| TgH = 82.5° C. | |

These two components were mixed to form a resin mixture (A/B=1.2; |TgL−TgH|=38.5° C.

| | |
|---|---|
| Resin mixture | 100 parts |
| Carbon black (R-330 of Cabot Corporation) | 10 parts |
| Low-molecular weight polypropylene (Viscol 660P of Sanyo Chemical Industries, Ltd.) | 5 parts |
| Bontron P-51 (product of Orient Chemical Industry Co., Ltd.) | 1 part |

The above-listed components were treated as in Example 1 to prepare a developer composition.

The evaluate the performance of the developer samples, various tests were conducted and the results are shown in Table 1 below.

TABLE 1

| | Fixing temperature[1] (°C.) | Offset temperature[2] (°C.) | Storage stability[3] | Fouling of PVC sheet[4] | Comminutability[5] (kg/h) |
|---|---|---|---|---|---|
| Example No. | | | | | |
| 1 | 160 | 250 | | | 30 |
| 2 | 145 | 240 | | | 35 |
| 3 | 150 | 240 | | | 32 |
| Comparative Example | | | | | |
| 1 | 200 | 240 | x | Δ | 25 |
| 2 | 160 | 230 | Δ | x | 27 |
| 3 | 210 | 230 | x | x | 18 |

[1]Measured with a fixing apparatus adapted from FX-4700. A wiping test was conducted to determine the minimum temperature of heated rollers that produced a fixed image which satisfied the requirements for a certain residual density.

[2]Measured with a fixing apparatus adapted from FX-4700. The temperature at which offsetting occurred in a solid patch of image.

[3]After storage for 17 h at 50° C. and at 50% RH, the sample was vibrated on a 63-μm sieve for 5 minutes to evaluate its blocking propensity: , more than 70 wt % passed; Δ, 40–70 wt % passed; x, less than 40 wt % passed.

[4]Evaluated in terms of transfer of the fixed image to a PVC sheet when allowed to stand at 40° C. for one week in contact with the PVA sheet containing 35 wt % of a plasticizer under pressure of 10 g/cm²: , no fouling; Δ, some fouling; x, extensive fouling.

[5]Evaluated in terms of pulverizing power to obtain a toner having an average particle size (d 50) of 12 μm ± 1.0 μm.

The toner of the present invention for use in development of a latent electrostatic image employs a binder resin having the characteristics specified hereinabove. The toner comprises a micropically phase-separated structure and exhibits not only good anti-offsetting properties but also improved fixability at low temperature. Therefore, the toner image produced from this toner can be fixed with smaller power consumption, or at a lower temperature, and will not foul polyvinyl chloride sheets used as copy files. In addition, the low-molecular weight polymer component of the toner is friable and can be readily comminuted to a desired particle size. Therefore, the toner of the present invention can be manufactured very efficiently at low cost. If the glass transition temperature TgL of the low-molecular weight polymer component and the glass transition temperature TgH of the high-molecular weight polymer component are adjusted to satisfy the condition $|TgL-TgH| \leqq 10°$ C., toner blocking and flowability, which have been excessive in the prior art on account of the low Tg of the low-molecular weight component, can be effectively controlled to realize a desired functionally separated toner.

While the invention has been described in detail and with reference to specific embodiments thereof, it will be apparent to one skilled in the art that various changes and modifications can be made therein without departing from the spirit and scope thereof.

What is claimed is:

1. A toner for development of a latent electrostatic image which comprises a colorant dispersed in a binder resin formed of a mixture of a low-molecular weight polymer component and a high-molecular weight component, said low-molecular weight and high-molecular weight components being made of a styrene-acrylic copolymer, wherein a weight ratio (A) of styrene to acrylic monomer in said low-molecular weight polymer component and a weight ratio (B) of styrene to acrylic monomer in said high-molecular weight polymer satisfies the relationship $A/B > 1.3$; the mixing ratio of said low molecular weight and high-molecular weight components is within the range of from 80:20 to 40:60; and the weight-average molecular weight (Mw) and the number-average molecular weight (Mn) of said low-molecular weight polymer component satisfies the relationship $Mw/Mn \leqq 3.0$.

2. A toner according to claim 1, wherein a glass transition temperature TgL of said low-molecular weight polymer component and a glass transition temperature TgH of said high-molecular weight polymer component satisfies the relationship $|TgL-TgH| \leqq 10°$ C.

3. The toner according to claim 1, wherein the high-molecular weight polymer component has a glass transition temperature TgH between 40° to 80° C.

4. The toner according to claim 1, wherein the low-molecular weight polymer component has a glass transition temperature TgL between 40° to 80° C.

5. The toner according to claim 1, wherein the high-molecular weight polymer component has a weight-average molecular weight (Mw) between about $1 \times 10^5$ to $1 \times 10^6$ and a number-average molecular weight (Mn) between about $1 \times 10^5$ to $5 \times 10^5$.

6. The toner according to claim 1, wherein the low-molecular weight polymer component has a weight-average molecular weight (Mw) between about $2 \times 10^3$ to $3 \times 10^4$ and a number-average molecular weight between about $2 \times 10^3$ to $1 \times 10^4$.

7. The toner according to claim 1, wherein said relationship Mw/Mn is $>2.5$.

8. The toner according to claim 1, wherein styrene monomers of said styrene-acrylic copolymers are selected from the group consisting of styrenes and substituted styrenes.

9. The toner according to claim 1, wherein acrylic monomers of said styrene-acrylic copolymers are selected from the group consisting of methyl acrylate, ethyl acrylate, butyl acrylate, dodecyl acrylate, octyl acrylate, phenyl acrylate, ethyl methacrylate, butyl methacrylate, dodecyl methacrylate and methyl methacrylate.

10. The toner according to claim 1, wherein said colorant is selected from the group consisting of carbon black, nigrosine dyes, aniline blue, calcoil blue, chrome yellow, ultramarine blue, Du Pont oil red, quinoline yellow, methylene blue chloride, phthalocyanine blue, malchite green oxalate, lamp black and rose bengale.

* * * * *

UNITED STATES PATENT AND TRADEMARK OFFICE

CERTIFICATE OF CORRECTION

PATENT NO. : 4,973,538

DATED : November 27, 1990

INVENTOR(S) : Chiaki Suzuki et al.

It is certified that error appears in the above-identified patent and that said Letters Patent is hereby corrected as shown below:

ON TITLE PAGE: Title, change "SEPRATED" to --SEPARATED--;

In the Abstract, Line 9, after "and" delete [an];

In the Abstract, Line 11, change "<" to -->--;

Claim 7, Column 10, Line 68, change ">" to --<--;

Claim 10, Column 12, Line 8, change "malchite" to --malachite--.

Signed and Sealed this

Thirteenth Day of October, 1992

*Attest:*

DOUGLAS B. COMER

*Attesting Officer*

*Acting Commissioner of Patents and Trademarks*